United States Patent [19]

Thode

[11] 4,168,581

[45] Sep. 25, 1979

[54] COOLING CONTAINER VESSEL HAVING A COOLING SYSTEM

[75] Inventor: Herberd Thode, Bad Schwartau, Fed. Rep. of Germany

[73] Assignee: O & K Orenstein & Koppel Aktiengesellschaft Werk Lübeck, Fed. Rep. of Germany

[21] Appl. No.: 904,886

[22] Filed: May 11, 1978

[30] Foreign Application Priority Data

May 12, 1977 [DE] Fed. Rep. of Germany ..... 2721327
Feb. 13, 1978 [DE] Fed. Rep. of Germany ..... 2805974

[51] Int. Cl.[2] ..... F26B 19/00

[52] U.S. Cl. ..... 34/233; 62/240; 114/76

[58] Field of Search ..... 34/225, 233, 224, 232; 62/239, 240; 165/42; 114/76; 312/351

[56] References Cited

U.S. PATENT DOCUMENTS 2,529,651 11/1950 Davis ..... 62/240
3,486,553 12/1969 Roberts ..... 62/240 X

FOREIGN PATENT DOCUMENTS 2264512 3/1974 France ..... 34/233

*Primary Examiner*—Edward G. Favors
*Attorney, Agent, or Firm*—McGlew and Tuttle

[57] ABSTRACT

A cooling container vessel, comprises a vessel hull with spaced apart bulkheads which define a storage space therebetween and which includes substantially vertically arranged guide frames disposed in the space at spaced locations from the bulkheads alongside a vertically elongated manifold for the supply of cooling air. A plurality of horizontally extending double-walled cargo supporting structures are engaged with the frames and are supported thereby in a horizontal position. The double-walled cargo supporting structures are provided with an interior cavity which is supplied with cooling air by a connection carried thereby which may be engaged with a connection to the manifold and include at least one wall which has openings for the flow of cooling air into the cavity of the double-walled supporting structures and outwardly through the openings in the wall thereof.

8 Claims, 11 Drawing Figures

COOLING CONTAINER VESSEL HAVING A COOLING SYSTEM

FIELD AND BACKGROUND OF THE INVENTION

This invention relates to ship construction in general and, in particular, to a new and useful cooling container vessel, comprising guides for stowing the containers and a cooling system with means for connecting the system to the cool-air connecting sockets of the containers.

DESCRIPTION OF THE PRIOR ART

A cooling container vessel of this kind is known in which a cool-air producing equipment is secured in the cargo space to one or a plurality of walls or bulkheads extending lengthwise or crosswise of the vessel. One or more air ducts are connected thereto on which sockets or couplings for connecting the cooling containers are provided. The air ducts may be designed as double conduits, one for the supply and the other for the return of the air. The air ducts are thermally insulated. Each container is provided with two connections, one for the air supply and one for evacuation, see German Offenlegungsschrift No. 1,953,866. Still other designs of cooling container vessels are known or possible wherein each individual container or groups of containers can be connected to the cool air system.

A ventilating system for preventing dew water from condensating on containers stowed aboard a vessel is also known which comprises an air circulating and, if provided, air conditioning equipment. This system again includes an air distributing part with a main duct and secondary ducts and with connections for introducing the air into the containers, with the air, after having passed through the containers, escaping into the cargo space through openings in the container walls. In this case, the air is directed through secondary ducts provided in the double bottom of the vessel into vertical uptake pipes extending through each of the container stacks.

The air uptake pipes form part of each container and they comprise a plurality of partial lengths associated with the respective containers which, in the course of stacking, the containers are joined to the main uptake by crimped connections. In the zone of the container, each partial length of the uptake is provided with outlet slots for introducing the air into the container. The air introduced into the container may be appropriately guided within the container and it escapes into the cargo space through openings provided in the container walls, see German Auslegeschrift No. 2,149,475.

Finally, for storage or cooling rooms of vessels, it is known to use so-called gratings which are placed on the floor of the respective space to enable the air to flow past the stacked goods. The goods are to be stored slightly spaced from the vessel bottom. Known gratings are made of wood or of extruded aluminum sections having a perforated supporting surface. Also known are gratings for storage and cooling spaces of vessels made of formed steel strips which are provided with perforated supporting surfaces. The supporting surfaces are in turn supported by downwardly extending sidewalls and perforated cross-walls provided therebetween. In the cross-webs and/or between them, etc., air passages are provided in the gratings, see German Auslegeschrift No. 1,197,344.

If the container vessel is to carry general cargo, it is further known to provide removable intermediate decks in the vessel hold. These are secured, in a suitable manner, to the guides for stowing the containers. For this purpose, the guides are connected to each other by horizontal supporting beams on which the intermediate decks, which are reinforced or trussed, can be placed, see German Offenlegunsschrift No. 2,211,452.

Another possibility of loading a container vessel storage space with cargo along with other containers of usual size is to provide plate-like bodies (pallets) having a surface area which is equal to the total base area of a plurality of containers of standard size. The pallets comprise a plurality of perpendicularly crossed beams which are connected to each other and form the pallet frame. The pallet body is provided with corner fixtures with which the pallets are secured to the container guides, see German Offenlegungsschrift No. 2,211,452.

SUMMARY OF THE INVENTION

The present invention is directed to a cooling container vessel of a design such that the cooling air flows not only around or through the cooling containers but, in addition, the air also cools the general cargo which has been stored in the cooling container vessel instead of cooling containers. For this purpose, in a cooling container vessel, in accordance with the invention, double-walled supporting structures (intermediate deck sections) are provided, which are insertable into the guide frames of the containers and have passage openings for the cool air in their upper supporting wall, and are provided with connecting means for establishing connection with the air supply connections of the cooling system.

The inventive device has the advantage that the structures to be inserted into the guide frames for stowing the containers can also be used for storing general cargo and for distributing the cool air within the space occupied by the general cargo. The entire cargo is thereby uniformly cooled. The supporting structures may comprise one or more connections or couplings for establishing connection with the cooling system. The connections may be of the known kind used in insulated cooling containers, and the connections of the inventive device may also be similar to those of cooling containers of the prior art.

As far as the cooling system is provided with exhaust openings or exhaust connections which are connectable to the outlet connections of cooling containers in the manner described above, the air is evacuated by the inventive device from the area of the general cargo pile through these exhaust openings. In addition, it is also possible from known constructions to insulate the entire storage space of the cooling container vessel.

According to a development of the invention, a hollow connecting member which comprises connecting means may be provided on the upper supporting wall of the intermediate deck section and this connecting member may be removable. When not in use, the inventive insertable structures may be piled up on the floor of the storage spaces or put aside in such a space at a suitable location. In this case, the hollow connecting members are removed. Containers may be placed or stored on top of the inventive structures, and the latter are accordingly of a correspondingly rigid construction. The inventive structures may be moved by means of the board tackle or shore-based cranes.

According to a further development of the invention, the inventive insertable structures may be hinged at a suitable location to the hull. In addition, the connecting means for establishing connection with the air supply or exhaust system may be of various design and may be removable or hinged to the structure.

In another embodiment of the invention, the double-walled supporting structure or intermediate deck section may be provided with a hatch which is closable with a hatch cover which is also double-walled, and which includes an air passage opening in its upper wall. In this case, the cavity formed between the supporting walls of the intermediate deck section communicates with the cavity formed between the walls of the double-walled hatch cover through openings which are aligned with each other. The provision of hatches in the individual intermediate deck sections makes the vessels mor suitable for carrying general cargo. For loading of the vessel, it is no longer necessary to remove the entire intermediate deck sections, but it is only necessary to pen the hatch.

According to a further development of this embodiment of the invention, the hatch cover may be provided with a projecting border portion which is supported on a corresponding recess portion on the border of the hatch of the intermediate deck section, and the engaging border portions of the hatch cover and the hatch are provided with openings which correspond to each other. This embodiment has the advantage that the air flow in the intermediate deck section is not interrupted by the hatch cover, since the hatch cover forms a part of the air circuit.

To ensure the cooling of the general cargo to be cooled in a completely satisfactory manner, a further development of the invention provides that the upper supporting wall of the intermediate deck section and the upper wall of the double-walled hatch cover are easily detachable from their respective lower parts. This makes it possible, in a simple manner, to remove the upper supporting wall and to clean the air passageways from dirt hindering the flow, so that the stored general cargo is always properly cooled. In order that the cooling conditions are not disturbed in the other spaces separated by the intermediate deck sections, while loading one of the storage spaces of the vessel, or during a failure of the ventilating system, the lower supporting wall of the intermediate deck section and/or the lower supporting wall of the hatch cover may be provided, with a thermal insulation, in accordance with another feature of the invention. This ensures that the cooling temperature in the respective spaces is kept at the desired level even if, for any reason, the room temperature in an adjacent space changes.

Accordingly, it is an object of the invention to provide a vessel which includes a storage space defined in the hull with vertically disposed frame members which support one or more intermediate deck sections which are of a double-walled construction and which include an air cavity therein with means for connecting the cavity to a cooling air supply manifold for the circulation of air through the cavity and out through openings in a wall of the double-walled structure.

A further object of the invention is to provide a vessel having intermediate deck structures of double-walled construction through which air may be circulated, and which may include one or more bulkhead closures which are also of double-walled construction so as to define a cavity in the bulkhead which communicates with a cavity in the deck structure, so that cooling air may be circulated through the deck structure as well as the hatch cover and out through openings of each.

Another object of the invention is to provide a cooling container vessel having a cooling system, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
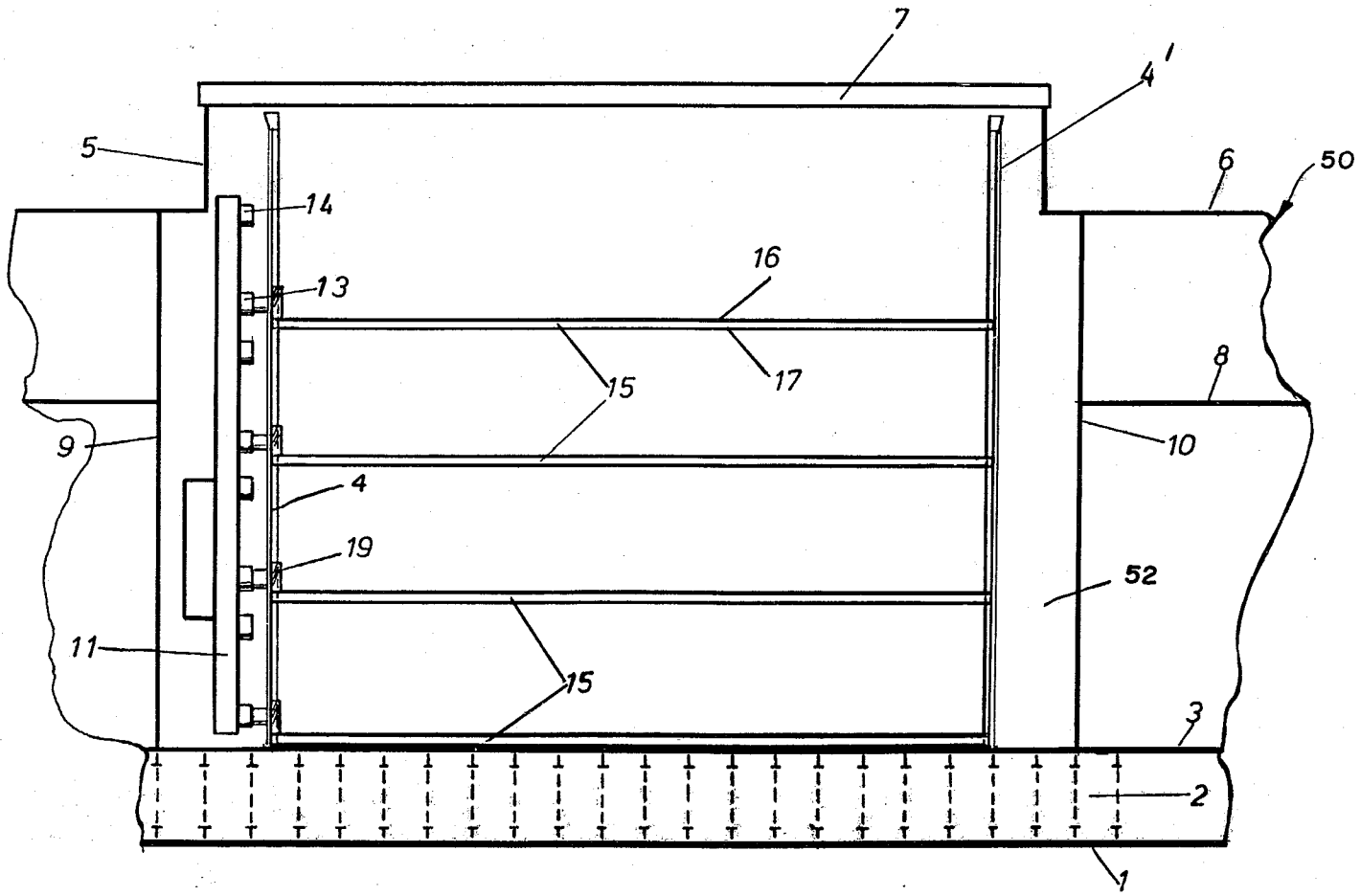
FIG. 1 is a longitudinal sectional view of a vessel, with a single guide frame for large size (40') containers.

Referring to the drawings in particular, the invention embodied therein, comprises, a vessel, generally designated 50, which has one or more cargo space areas 52 defined between bulkhead means including, for example, vertical bulkheads 9 and 10 located at spaced longitudinal locations along the vessel hull. The outside bottom wall 1 of the vessel 50 has a double bottom 2 with an inner wall or tank deck 3 which extends above the outside bottom wall 1. Guide frames 4 for cargo containers extend through the cargo hold from the tank deck 3 up to about the level of the hatch covering 5 closing the main deck 6 and supporting the hatch cover 7. The intermediate deck is indicated at 8. A cooling space 52 extends between bulkheads 9 and 10.

Figure 2:
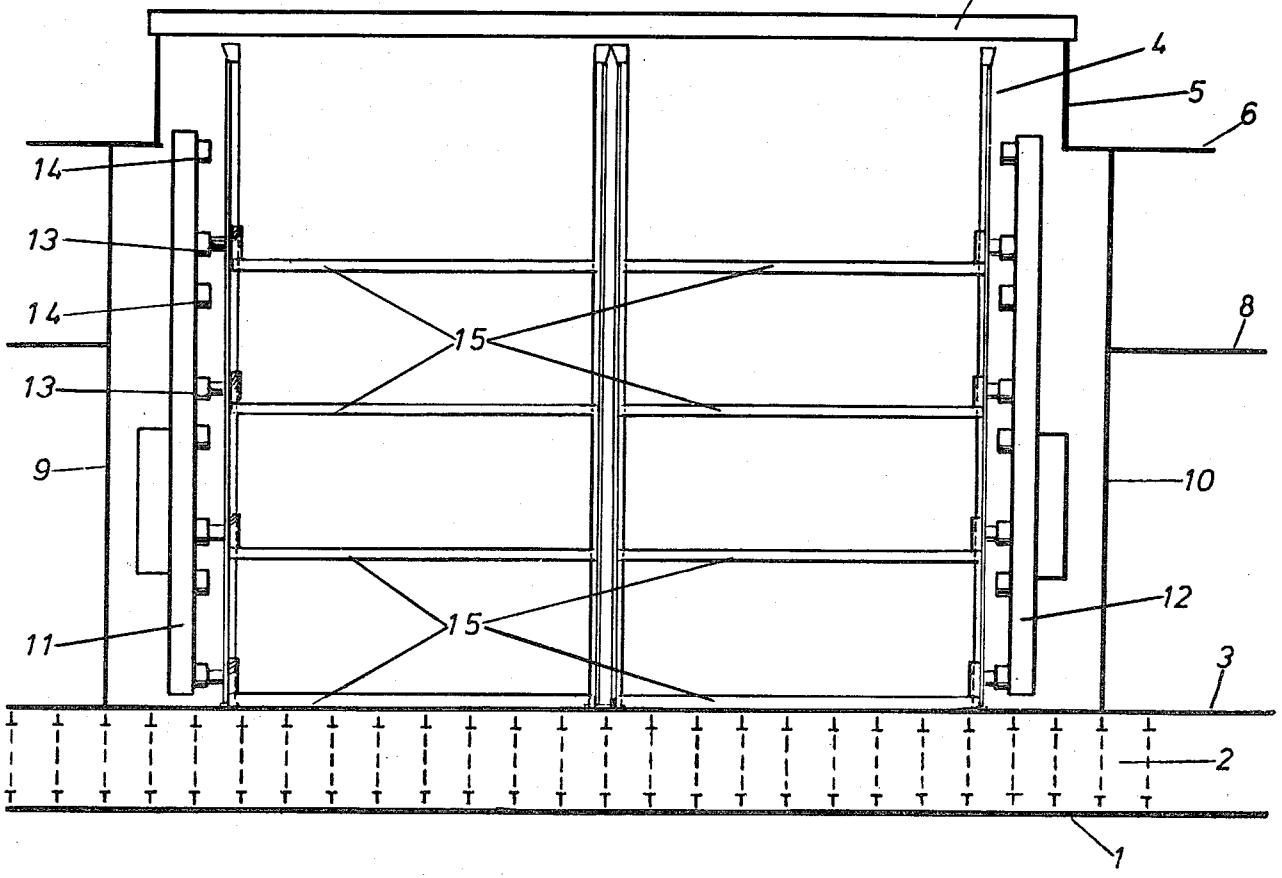
FIG. 2 is a view similar to FIG. 1 with two guide frames for smaller (20') containers.

The cooling air is prepared in a separate plant (not shown) and is supplied through distribution manifolds 11 (FIG. 1) and 12 (FIG. 2) which are provided alongside guide frames 4 and 4' for the containers.

The cooling air is directed through respective ducts (not shown in detail) to supply connections 13, while the escaping air is taken out by suction through exhaust connections 14 which are also secured to distribution manifolds 11 and 12. The conduits of the cool air and the used air are not shown in detail.

Figure 4:
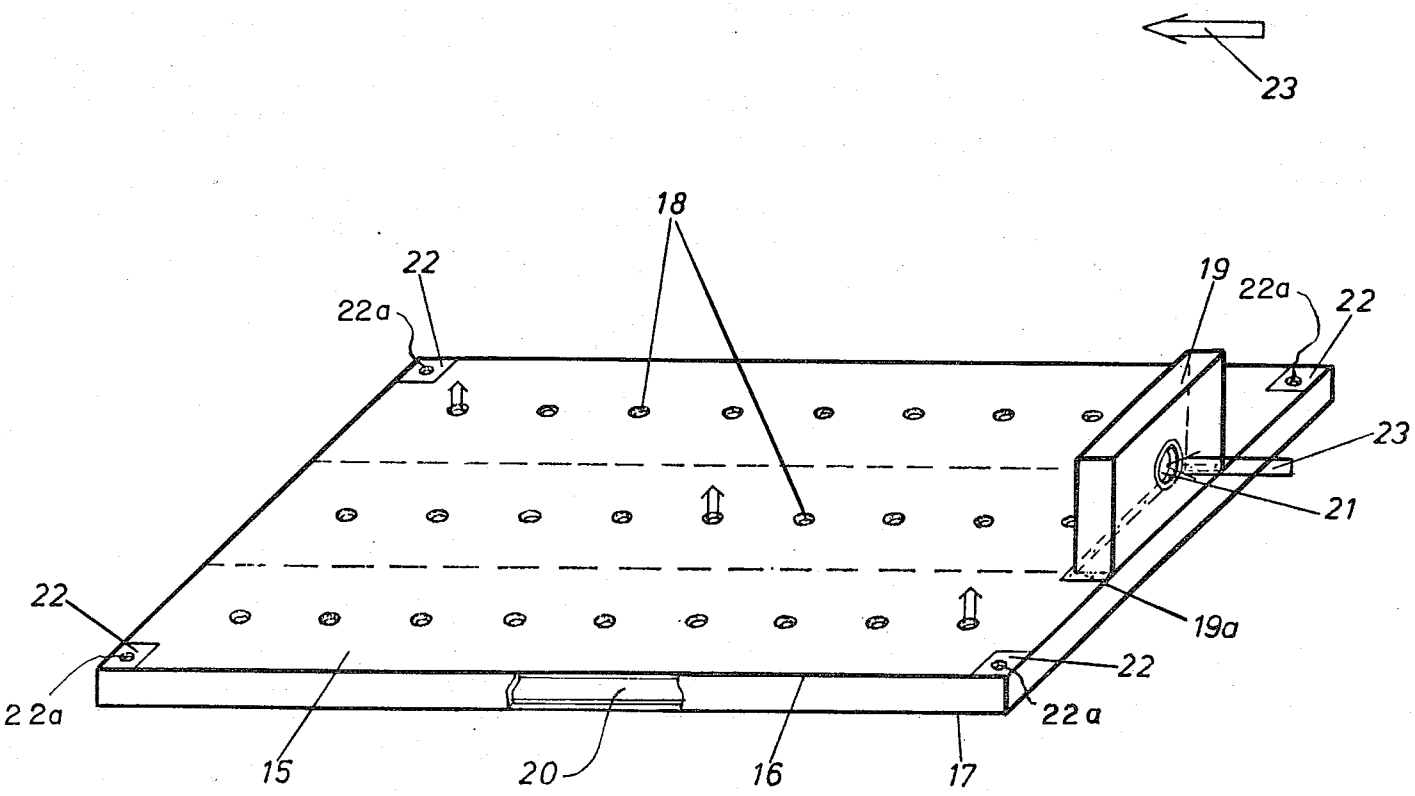
FIG. 4 is a front top perspective view of an intermediate deck section having a surface area corresponding to a 20' container.
Figure 5:
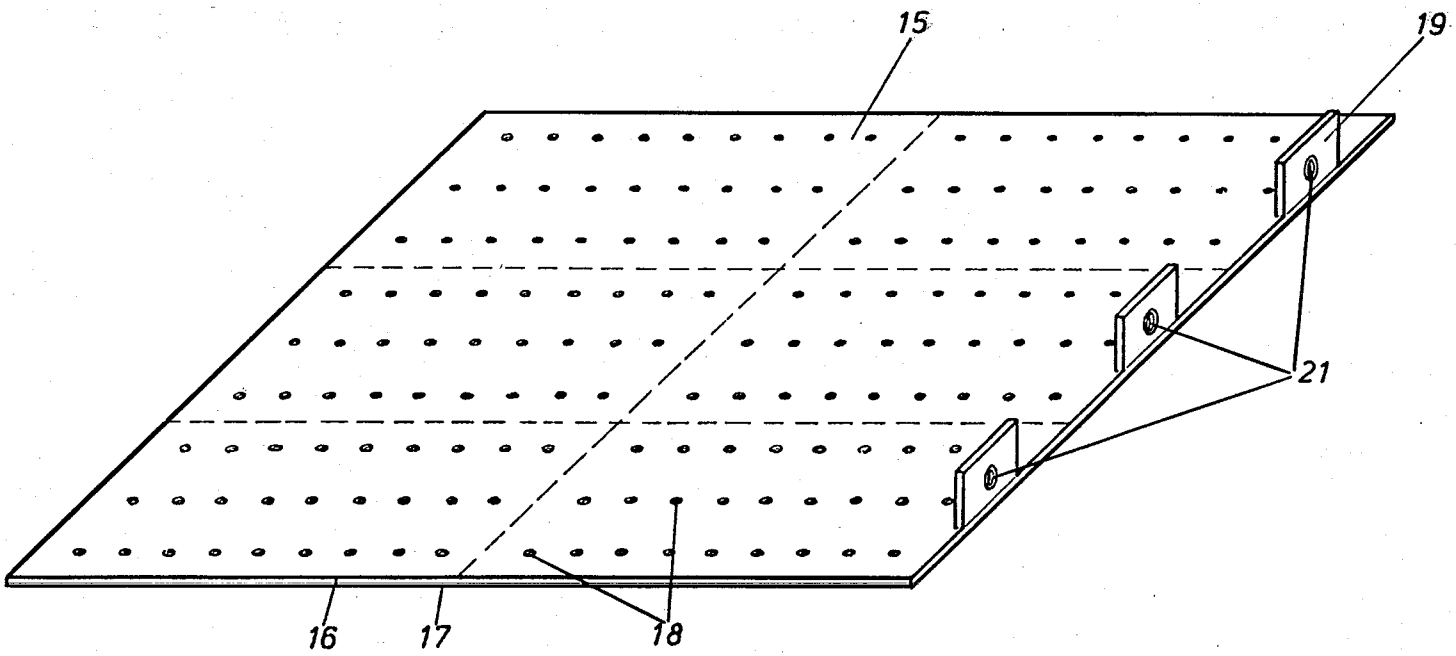
FIG. 5 is a view similar to FIG. 4 of an intermediate deck section having a surface area corresponding to six 20' containers or three 40' containers.
Figure 6:
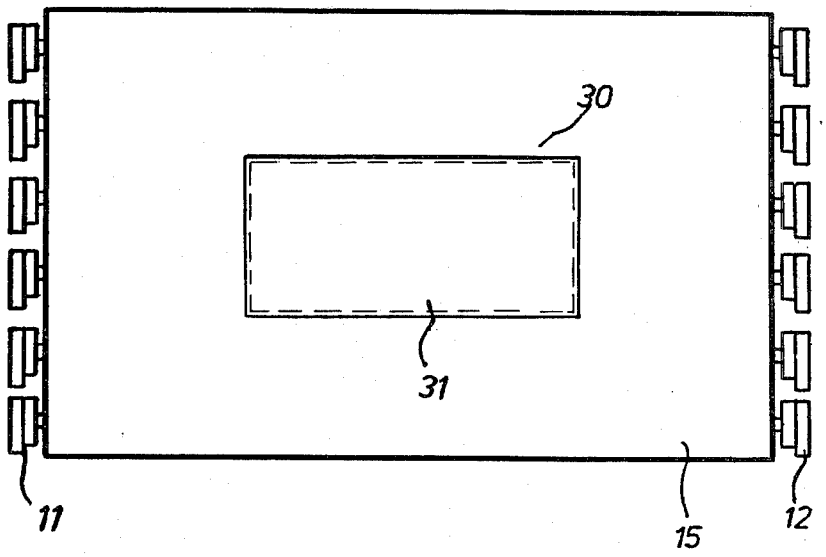
FIG. 6 is a top plan view of an intermediate deck section comprising a hatch cover.
Figure 7:
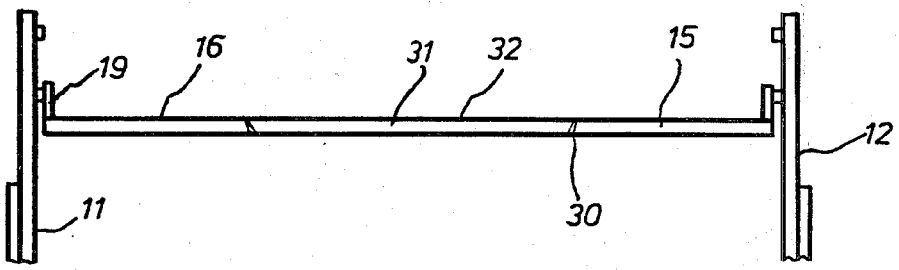
FIG. 7 is a side elevational view corresponding to FIG. 6.

Intermediate deck sections 15 are connected to supply connections 13. Sections 15 comprise double-walled supporting structures which are formed of an upper supporting wall 16 and a lower supporting wall 17. Upper supporting wall 16 is provided with passage openings 18 for the cool air (FIGS. 4 and 5). Intermediate deck sections 15 are provided with hollow connecting members 19, the interior of which communicates with the cavity 20 formed between supporting walls 16 and 17. Connecting members 19 comprise connecting means 21 by which they can be connected in a suitable manner to supply connections 13.

Connecting members 19 are provided with mounting straps 19*a* by which they are detachably secured to the upper supporting wall 16. On their four corners 22, intermediate deck sections 15 are provided with fastening means, such as securing belt holes 22*a*, by which they can be suspended from or secured to guide frames 4 of the containers. After a section is fixed in place, connection is established between the connecting means 21 and supply connection 13.

General cargo is stored in the space between intermediate deck sections 15. FIG. 4 shows an intermediate deck section for one 20′ container, while FIG. 5 shows an intermediate deck section for six 20′ containers. In the latter case, the intermediate deck section is provided with three connecting members 19, so that there is a sufficient number of cool air connections permitting a uniform cool air flow through the entire extension of the intermediate deck section.

Figure 3:
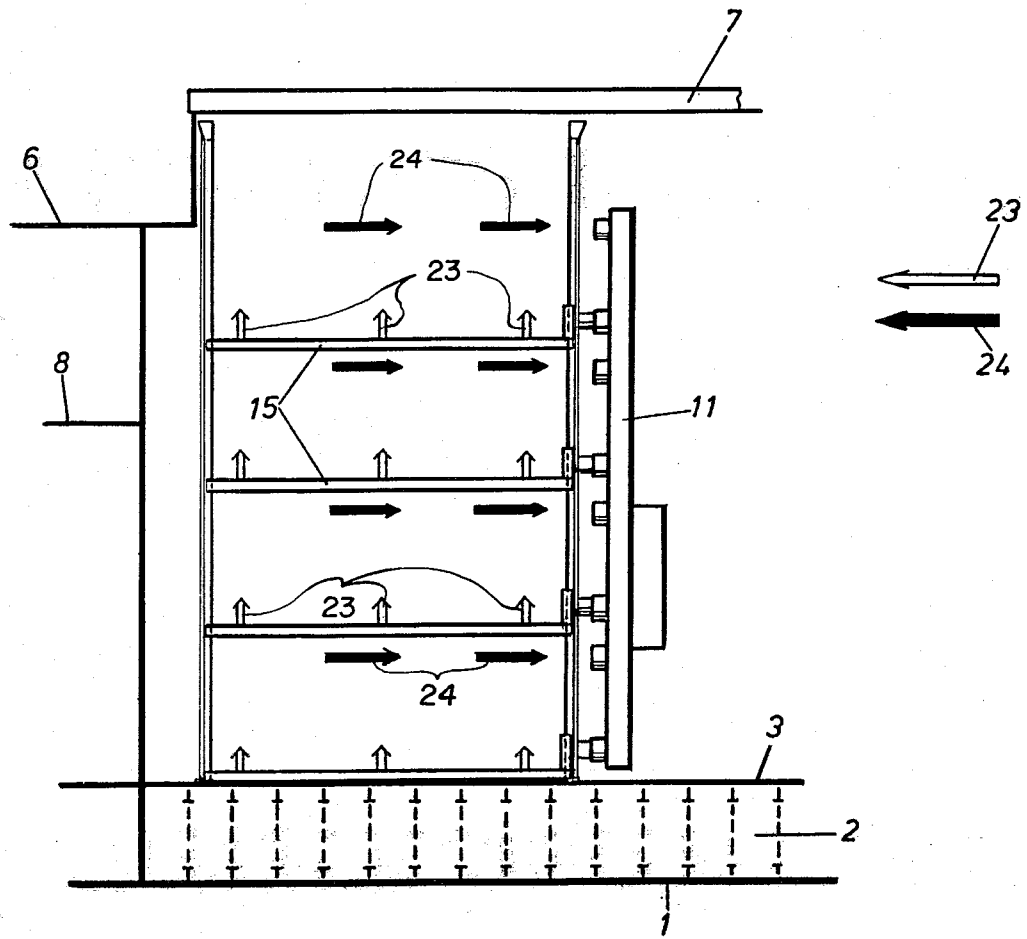
FIG. 3 is a view, similar to FIG. 1, showing the air circulation within one part of the vessel.

FIG. 3 shows the air circulation in the space between the intermediate deck sections, with double-line arrows 23 indicating the cool air supply, and solid arrows 24 indicating the escape of the air. The used air is taken out by suction through exhaust connections 14. The inventive design has the advantage that the general cargo stored between the intermediate deck sections is kept uniformly cooled and at a constant temperature throughout.

In the embodiment of FIGS. 6 to 10, an opening or hatch 30 is provided in the central area of intermediate deck section 15, which is closed with a hatch cover 31, which is also of double-walled construction. An upper supporting wall 32 of the hatch cover 31 is provided with cool air passage openings 18 (shown in FIGS. 8*a* and 8*b*) in the same manner as upper supporting wall 16. The lower supporting wall 33 is solid.

Figure 8A:
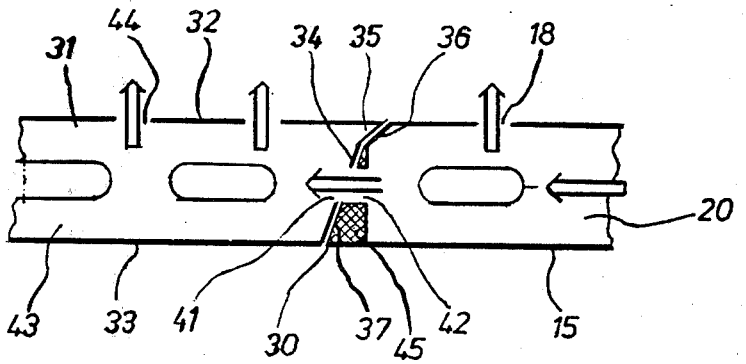
FIGS. 8*a* and 8*b* are enlarged partial sectional views showing two embodiments (a, b) of the hatch cover border.

In the design of FIG. 8*a*, the border 34 of hatch cover 31 is downwardly and inwardly beveled in steps, of which an upper, less inclined step portion 35 of the bevel engages a corresponding oblique supporting face 36 provided on a border 37 of hatch 30. In this manner, hatch cover 32 is supported on deck sections 15.

Figure 8B:
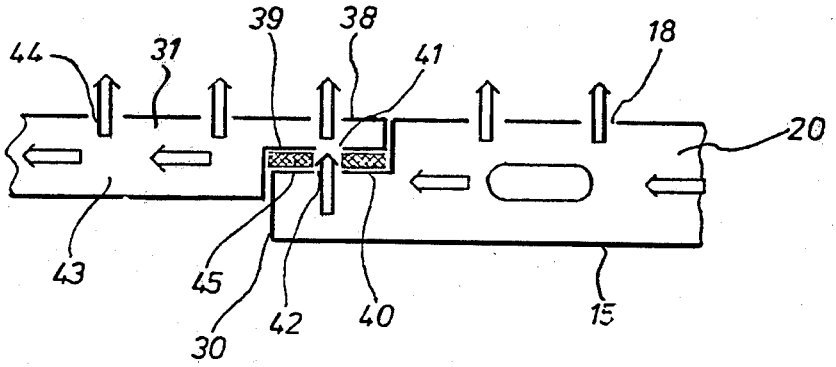

In the design of FIG. 8*b*, hatch cover 31 is provided with a projecting portion 38, with the underside 39 thereof engaging a recessed border portion 40 of the intermediate deck section. In both designs, the engaging portions or portions facing each other 34, 37, 39, 40 are provided with openings 41, 42 which are aligned with each other, so that the air can flow from the inner space 20 of intermediate deck section 15 into an inner space 43 of the double-walled hatch cover 31 and then pass through openings 44 upwardly. Perimetrically extending sealings 45 may be provided for sealing the gap between the edge portions facing each other of the hatch and the cover.

Figure 10:
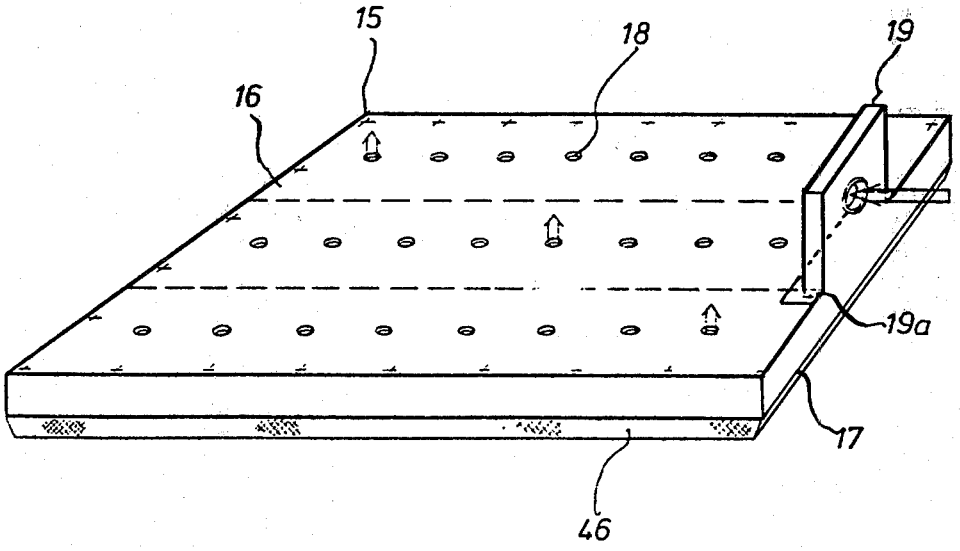
FIG. 10 shows the intermediate deck section of FIG. 9 provided with a thermally insulating layer.
Figure 9:
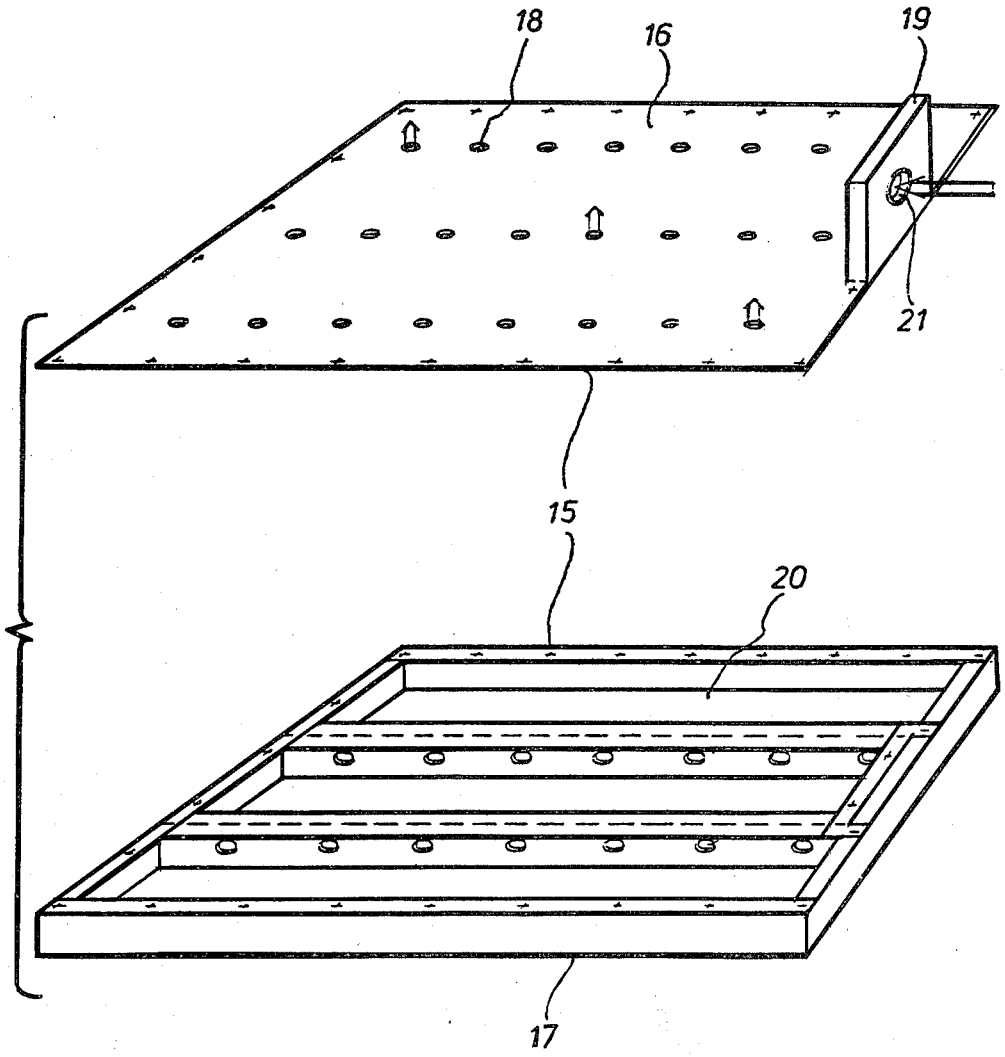
FIG. 9 is an exploded perspective view of an intermediate deck section with the upper supporting wall removed.

In the embodiment of FIGS. 9 and 10, supporting wall 16 of intermediate deck section 15 is connected to the lower supporting wall 17 in an easily detachable manner. The wall 17 may be of box-like construction. The upper supporting wall 16 may be provided with the connecting member of coupling 19 which may, however, also be secured to the lower supporting wall of box-like construction. In the embodiment of FIG. 10, the lower supporting wall 17 is provided with a thermally insulating layer 46.

While specific embodiments of the invention have been shown and described in detail to illustrate the application of the principles of the invention, it will be understood that the invention may be embodied otherwise without departing from such principles.

What is claimed is:

1. A cooling container vessel, comprising, spaced apart first and second bulkhead means defining a storage space therebetween, substantially vertical guide frame means disposed in spaced relationship to said first and second bulkhead means in the storage space, at least one cooling and distribution manifold alongside said guide frame means for delivering circulating cooling air and conducting away circulated cooling air, at least one horizontally extending double-walled cargo supporting structure engageable with said support frame means and supported thereby and forming an intermediate deck section and having an intermediate air flow cavity between said double walls with openings in at least one of said walls for the outward flow of cooling air, and connecting means on said double-walled cargo supporting structure for connecting said flow cavities to said manifold for the flow of cooling air from said manifold to said flow cavity and out the opening thereof.

2. A cooling container vessel, as claimed in claim 1, wherein said double-wall supporting structure comprises a member having upper and lower spaced apart walls, said connecting means comprising a member mounted on the upper one of said walls and having a side adjacent the manifold with an opening therein for connection to said manifold.

3. A cooling container vessel, as claimed in claim 1, wherein said connecting means comprises a hollow connecting member mounted on said supporting structure and having an interior in communication with the cavity between said double walls, said connecting member being removable.

4. A cooling container vessel, as claimed in claim 1, wherein said supporting structure includes a hatch opening therein, a hatch cover engaged over the opening and closing it, said hatch cover including a hollow hatch cover cavity therein, said hatch cover having an opening adjacent the periphery thereof for communicating the hatch cover cavity with the cavity in said double wall supporting structure so that the cooling air will flow from the supporting structure into the hatch cover cavity.

5. A cooling container vessel, as claimed in claim 1, wherein said supporting structure has a hatch cover opening, the hatch cover closing the opening of said supporting structure, said hatch cover and said supporting structure having abutting peripheral areas with the peripheral abutting area of said supporting structure being bevelled inwardly toward the hatch cover so as to form a support therefor, said hatch cover having a complementary bevelled abutting area and at least one opening defined through the abutting areas of said hatch cover and said opening for the passage of cooling air, said hatch cover having an interior cavity with at least one opening from the cavity for the discharge of the cooling air.

6. A cooling container vessel, as claimed in claim 5, including a resilient seal member disposed between the abutting areas of said hatch cover and said supporting structure.

7. A cooling container vessel, as claimed in claim 1, wherein said supporting structure includes a hatch opening, a hatch cover engaged in said opening and being easily disengageable from said opening and being hollow and having a hatch cavity therein, means defining an air passage between said supporting structure and said hatch cover when said hatch cover is engaged with said supporting structure for the flow of air from the cavity of said supporting structure into the hatch cover cavity and at least one opening from the hatch cover cavity to the exterior thereof, said hatch cover being easily detachable from said supporting structure.

8. A cooling container vessel, as claimed in claim 7, wherein at least one wall of said supporting structure and said hatch cover are provided with a thermally insulating layer.

* * * * *